US005142886A

United States Patent [19]

Lonati

[11] Patent Number: 5,142,886

[45] Date of Patent: Sep. 1, 1992

[54] CIRCULAR KNITTING MACHINE WITH A DEVICE FOR REPREATING THE SELECTION OF THE NEEDLES AT LEAST AT ONE THREAD FEED

[75] Inventor: Francesco Lonati, Brescia, Italy

[73] Assignee: Lonati S.p.A., Brescia, Italy

[21] Appl. No.: 599,552

[22] Filed: Oct. 19, 1990

[30] Foreign Application Priority Data

Oct. 31, 1989 [IT] Italy ..... 22205 A/89

[51] Int. Cl.[5] ..... D04B 9/26

[52] U.S. Cl. ..... 66/222; 66/215; 66/8

[58] Field of Search ..... 66/8, 42 R, 222, 224, 66/215

[56] References Cited

U.S. PATENT DOCUMENTS

| | | | |
|---|---|---|---|
| 3,922,886 | 12/1975 | Moyer | 66/222 |
| 4,471,636 | 9/1984 | Lonati | 66/222 X |
| 4,538,431 | 9/1985 | Lonati | 66/224 |
| 4,932,226 | 6/1990 | Lonati | 66/222 X |

FOREIGN PATENT DOCUMENTS

| | | | |
|---|---|---|---|
| 2731091 | 2/1978 | Fed. Rep. of Germany | 66/222 |
| 2098634 | 11/1982 | United Kingdom | 66/222 |

*Primary Examiner*—Werner H. Schroeder
*Assistant Examiner*—John J. Calvert
*Attorney, Agent, or Firm*—Guido Modiano; Albert Josif

[57] ABSTRACT

The present machine has a device for repeating the selection of the needles at least at one thread feed, which includes a memory element arranged proximate to the lower end of the selectors, which can oscillate in a plane radial to the needle cylinder by virtue of the action of selection levers arranged upstream of a thread feed of the machine, according to the direction of the rotation imparted to the needle cylinder about its own axis. The selectors can individually oscillate in a radial plane with respect to the needle cylinder from an extraction position, whereat they protrude from the needle cylinder with a main heel so as to engage actuation cams arranged about the needle cylinder, to a sunk position, whereat they do not engage the cams. The memory element is controllably movable from an inoperative position, whereat it does not interfere with the oscillation of the selectors, to an operative position whereat, between two feeds of the machine, it maintains the position of the selectors imparted by the selection levers upstream of the first feed so that the performed selection is maintained at the second feed as well without requiring a new selection.

11 Claims, 4 Drawing Sheets

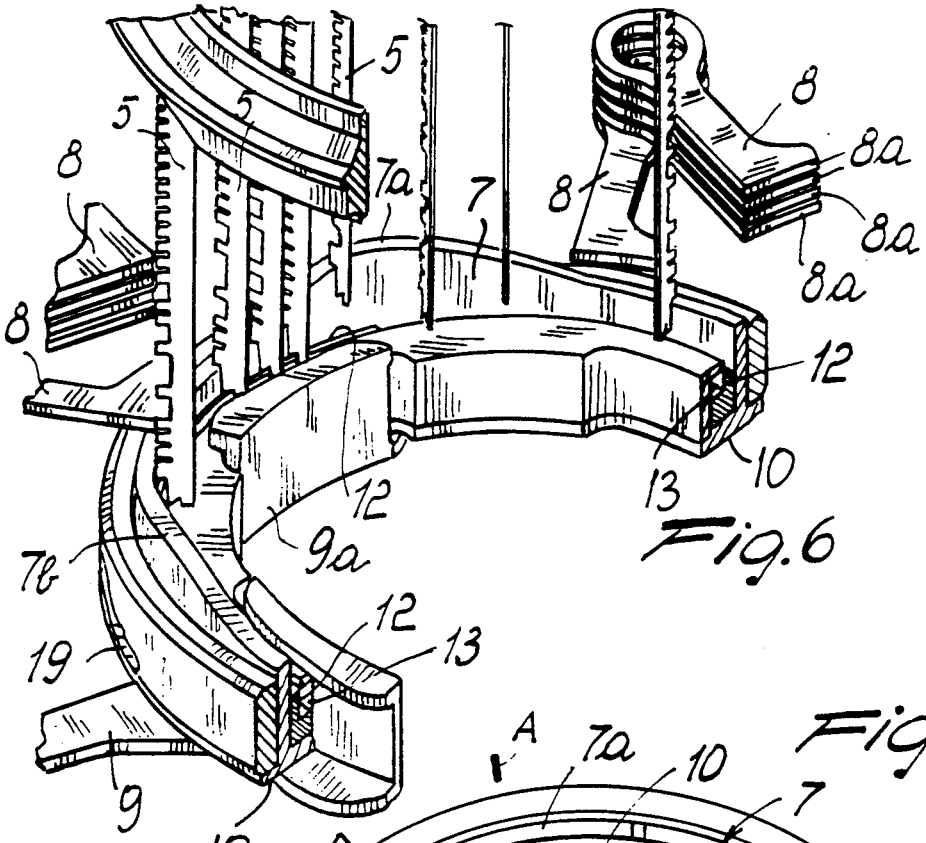
Fig. 6
Fig. 5
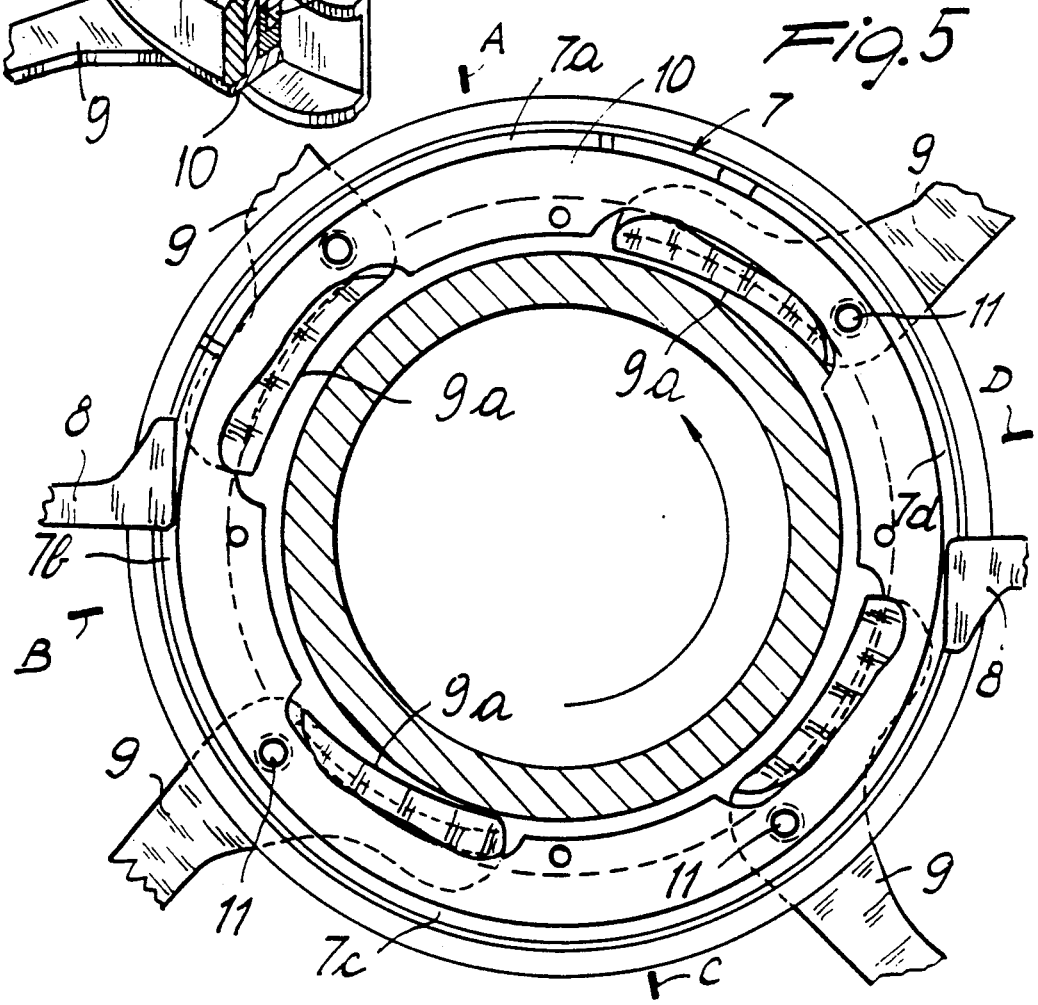

CIRCULAR KNITTING MACHINE WITH A DEVICE FOR REPREATING THE SELECTION OF THE NEEDLES AT LEAST AT ONE THREAD FEED

BACKGROUND OF THE INVENTION

The present invention relates to a circular knitting machine with a device for repeating the selection of the needles at least at one thread feed.

As known, circular knitting machines are generally constituted by a needle cylinder which has, on its lateral surface, a plurality of grooves which extend along a direction which is substantially parallel to its axis. A needle and a selector arranged below said needle are accommodated in each of said grooves so as to be slidable in a direction which is parallel to the axis of the needle cylinder. Each selector can oscillate in a radial plane of the needle cylinder, by virtue of the action of selection means which are arranged laterally facing the needle cylinder, from an extraction position, in which a main heel of the selectors protrudes radially from the needle cylinder, to a sunk position, in which said main heel is contained within the radial dimensions of the needle cylinder. One or more actuation cams are arranged around the needle cylinder, proximate to the main heel of the selectors, and define paths which can be engaged by said main heel when the selector is in the extraction position. The paths defined by the actuation cams have rising portions, so as to move upward the selectors which are engaged with their main heel within said paths so that they act with their end on the overlying needle to move it into a position suitable for engaging the thread fed at a thread feed of the machine, or so as to cause the passage of the heel of the overlying needle, which protrudes radially from the needle cylinder and is engaged within paths defined by other actuation cams which are located at the level of the heel of the needles, from one path to the other so as to diversify the knitting of the needles according to requirements.

The selection means are generally constituted by a plurality of levers which are mutually stacked in a direction which is parallel to the axis of the needle cylinder and are individually movable so as to interfere or not interfere with selection heels located at mutually different levels along the longitudinal extension of the selector. Extraction means are arranged upstream of the selection levers according to the direction of the rotation imparted to the needle cylinder about its axis relatively to the actuation cams; said extraction means act on the selectors in a sunk position so as to move them into the extraction position in order to undergo the action of the selection levers. According to the actuation of given selection levers and to the positioning of the selection heels along the selectors, the passage of preset selectors from the extraction position to the sunk position is caused, whereas other selectors arranged below the needles which must be moved to take the thread at the immediately subsequent feed are kept in the extraction position so as to engage the actuation cams which cause the lifting of the selectors and therefore of the overlying needles.

During some types of knitting, the need is felt to be able to repeat a same needle selection at a plurality of successive feeds of the machine without necessarily using the selection means every time, in order to contain costs.

For this purpose, the Applicant has already provided a device, which is the subject of the Japanese patent application No. 58-067880, which comprises a memory element arranged proximate to the lower end of the selectors and can maintain the position of the selectors, previously set with the selection means upstream of a first feed, between the first feed and a second feed, so that the same needles which knitted at the first feed knit at the second feed without the need to perform a new selection between the two feeds. More particularly, said memory element comprises a fixed cam constituted by a raised portion on the resting plane of the lower end of the selectors. Said raised portion defines two diversified paths for the lower end of the selectors, and more particularly: a first path, arranged between the raised portion and the selector actuation cams, within which the lower end of the selectors which are in extraction position after the selection performed upstream of the first feed engages, and a second path, arranged between the raised portion and the needle cylinder, within which the lower end of the selectors which are in sunk position after said selection engages.

The raised portion is fixed to the resting plane of the lower end of the selectors. In order to obtain the repetition of the selection only when required, a cam is provided upstream of said raised portion. The cam is movable in a radial direction with respect to the needle cylinder, whereby to move the lower ends of all the selectors lying in the first path. In this way the cam returns the selectors from the sunk position to the extraction position, so that the previously performed selection is cancelled and the selectors can be selected by further selection means arranged between the first feed and the second feed.

Through the years, research in this field has been aimed mainly at obtaining high rotation rates of the needle cylinder in order to increase the productivity of these machines.

Due to this fact, the above described memory device has some disadvantages in modern circular knitting machines.

More particularly, the use of a movable cam followed by a fixed cam, in this kind of device, causes an excessive wear of the selectors at high speeds which compromises the correct operation of said selectors. Again due to the fact that the combination of a fixed cam and of a movable cam is used, in order to avoid excessive impacts between said cams and said selectors great precision is furthermore necessary both in the execution of these elements and in their registration during assembly.

Even a very precise execution and registration in any case do not avoid impacts at high speeds between the selectors and the movable cam, since the selectors in a sunk position tend to move into the extraction position due to centrifugal force.

SUMMARY OF THE INVENTION

The aim of the present invention is to obviate the above described disadvantages by providing a circular knitting machine with a device for repeating the selection of the needles at least at one thread feed, which has excellent reliability in operation, even with high rotation rates of the needle cylinder, without causing excessive wear of the selectors.

Within the scope of this aim, an object of the invention is to provide a machine with a device for repeating the selection of the needles which is composed of a small number of elements which are simple to manufacture.

Another object of the invention is to provide a machine with a device for repeating the selection of the needles which prevents accidental passage of the selectors from the sunk position to the extraction position even at high rotational speeds of the needle cylinder.

This aim, these objects and others which will become apparent hereinafter are achieved by a circular knitting machine with a device for repeating the selection of the needles at least at one thread feed, which comprises: a needle cylinder with a plurality of grooves defined on its lateral surface, said grooves being substantially parallel to the axis of said needle cylinder, a needle and at least one selector below said needle being accommodated inside each of said grooves so as to be slidable along a direction substantially parallel to the axis of the needle cylinder, said selector being controllably oscillable, in a radial plane of the needle cylinder, from an extraction position, in which it protrudes radially from the needle cylinder with a main heel, to a sunk position, in which said main heel is contained in the radial dimensions of the needle cylinder; actuation cams arranged laterally facing the needle cylinder and defining paths engageable by said main heel, with said selector in an extraction position, for the movement of said selector along the related groove parallel to the axis of the needle cylinder upon the actuation of said needle cylinder with a rotary motion about its axis relatively to said actuation cams; at least two feeds mutually angularly spaced with respect to the axis of the needle cylinder; selection means arranged upstream of at least one of said feeds according to the direction of rotation of the needle cylinder relatively to said actuation cams and controllably interacting with said selectors for their passage from said extraction position to said sunk position or vice versa; characterized in that it comprises a memory element arranged proximate to the lower end of the selectors and having at least one portion with a curvilinear shape concentric to said needle cylinder, said memory element being arranged between said two feeds and is controllably movable from an inoperative position, whereat it does not interfere with the oscillation of said selectors, to an operative position, whereat it defines differentiated paths for the lower end of said selectors to maintain the position of said selectors set previously by said selection means.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, wherein:

FIG. 5 is a schematic sectional view of the machine, taken along a plane which is perpendicular to the axis of the needle cylinder, proximate to the lower base of said needle cylinder;

FIG. 6 is a schematic and partially sectional perspective view of a part of the machine, with the needle cylinder removed and with the memory element in an inoperative position;

DESCRIPTION OF THE PREFERRED EMBODIMENTS

Figures 1, 2:
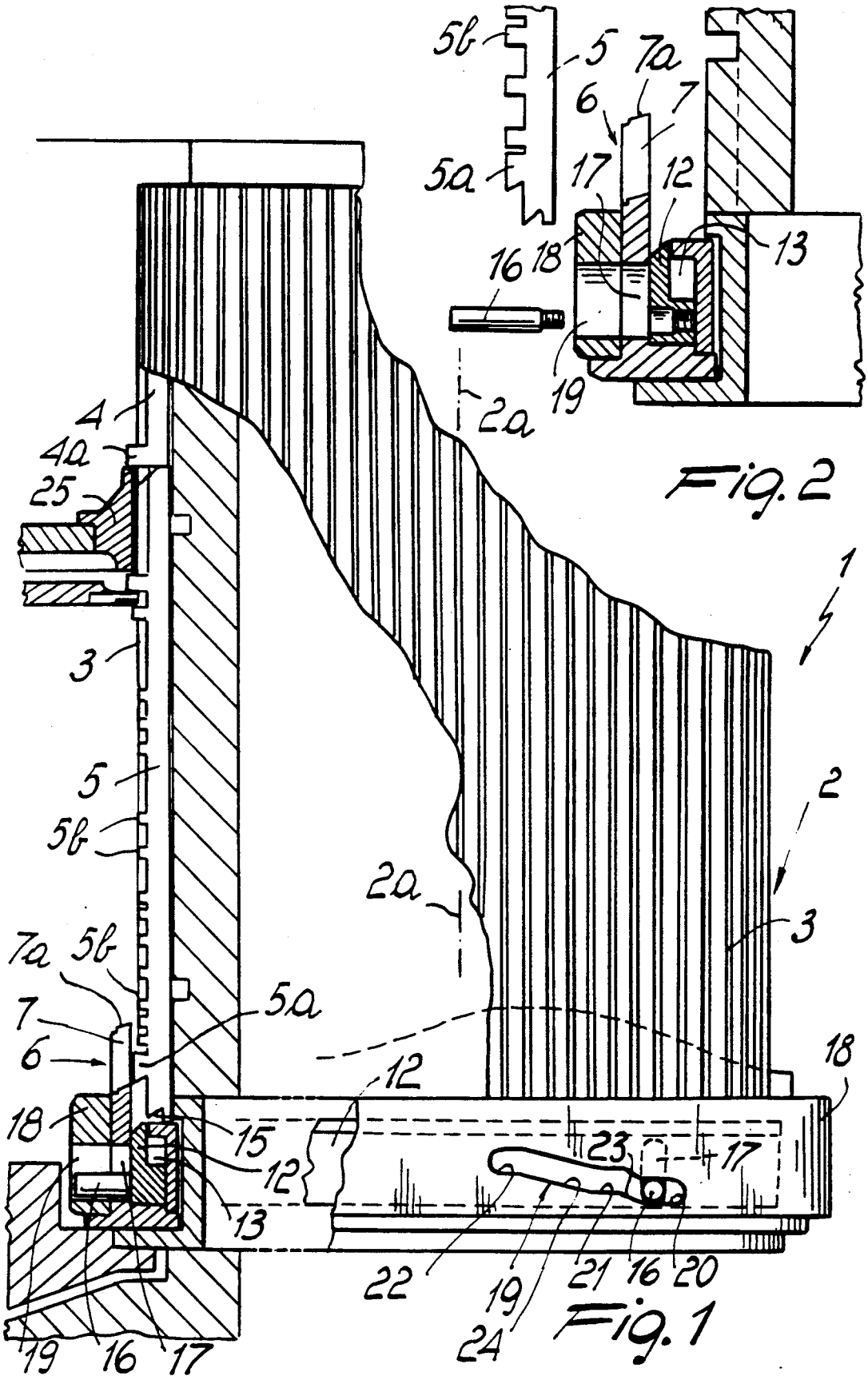
FIG. 1 is a partially sectional lateral elevation view of a detail of the machine related to a portion of the needle cylinder and to the device for repeating the selection of the needles according to the invention, with the memory element in an inoperative position.
FIG. 2 is an enlarged exploded view of a detail of FIG. 1.
Figure 9:
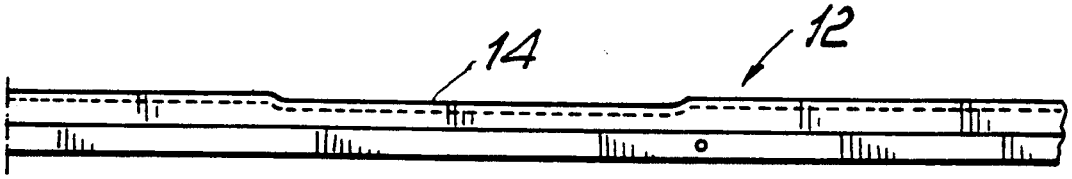
FIG. 9 is a view of the planar extension of a portion of the memory element according to the invention.
Figure 3:
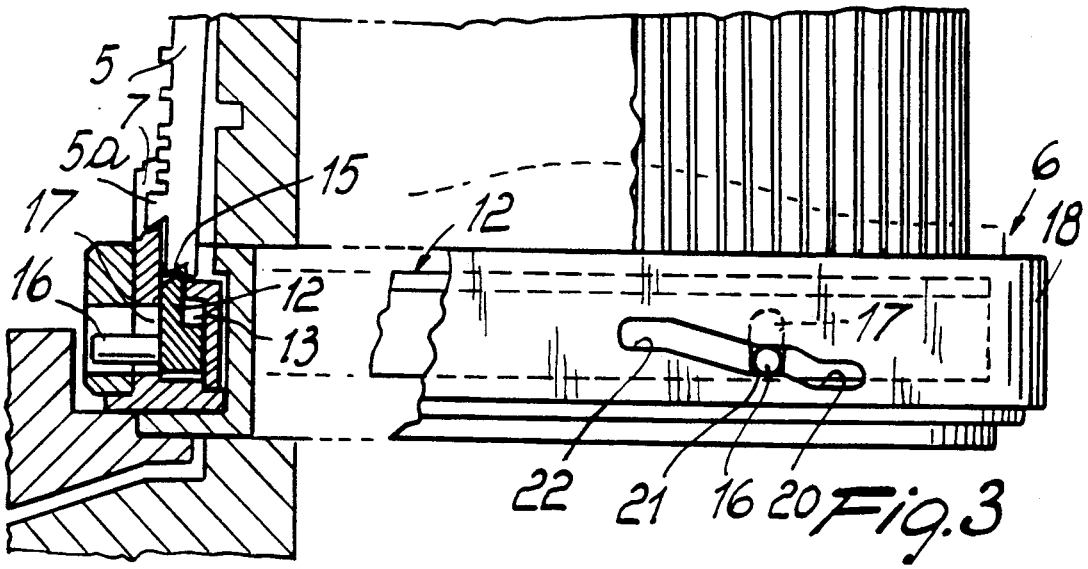
FIG. 3 is a partially sectional view, taken similarly to FIG. 1, with the memory element in an operative position.
Figure 4:
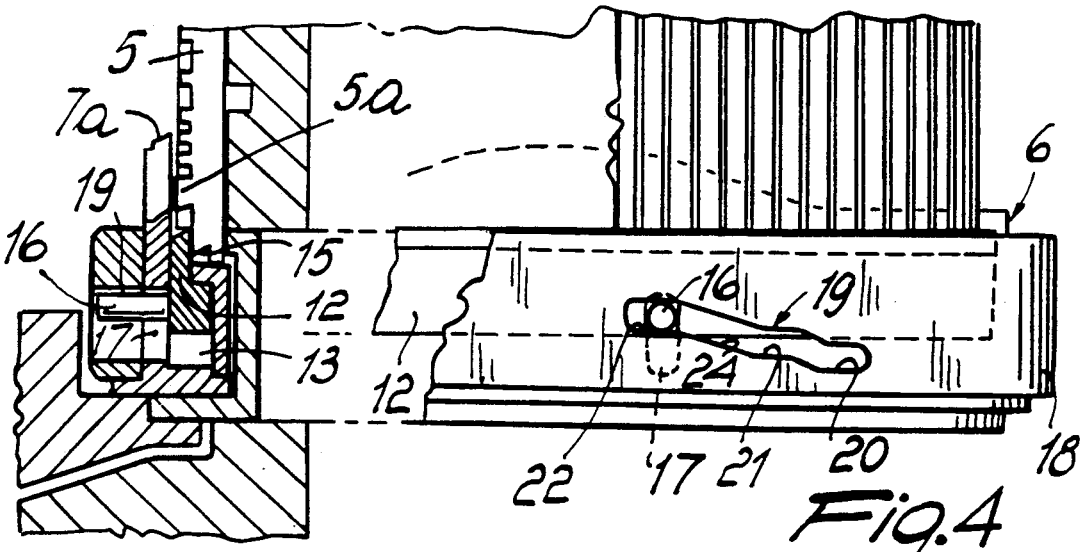
FIG. 4 is a view, taken similarly to FIGS. 1 and 3, with the memory element raised further to lock the selectors in a radial direction.
Figure 8:
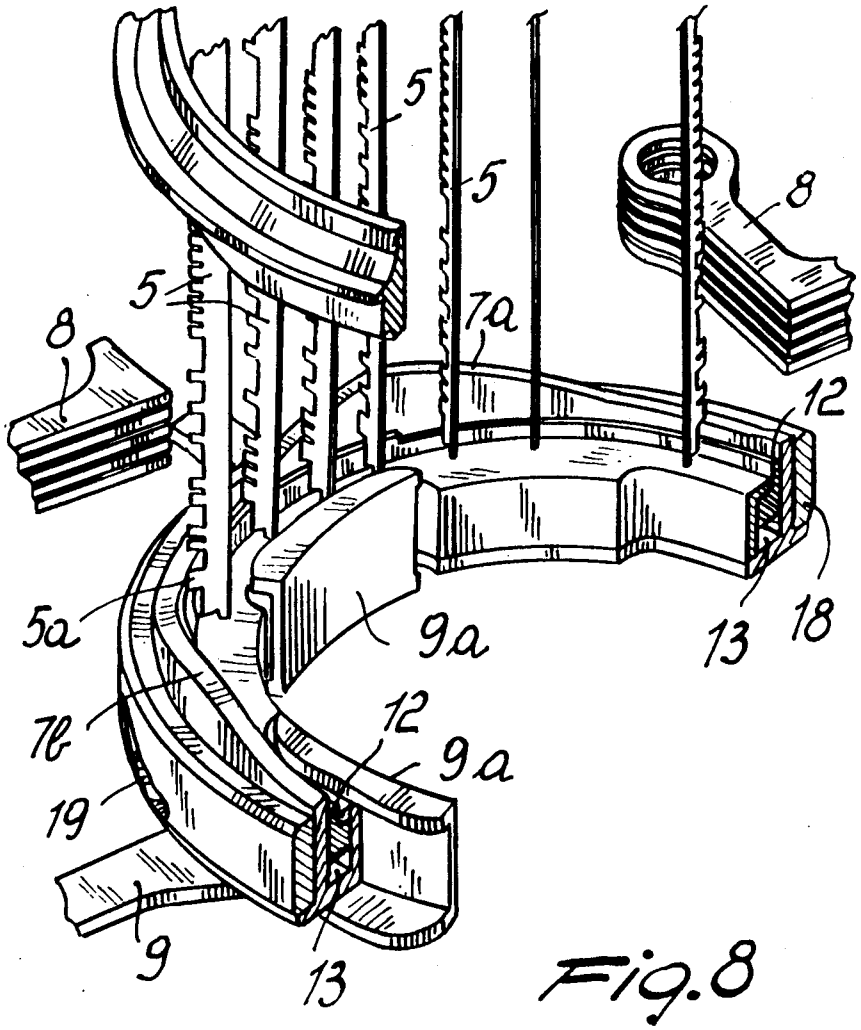
FIG. 8 is a perspective view, taken similarly to FIGS. 6 and 7, with the memory element in the position illustrated in FIG. 4.
Figure 7:
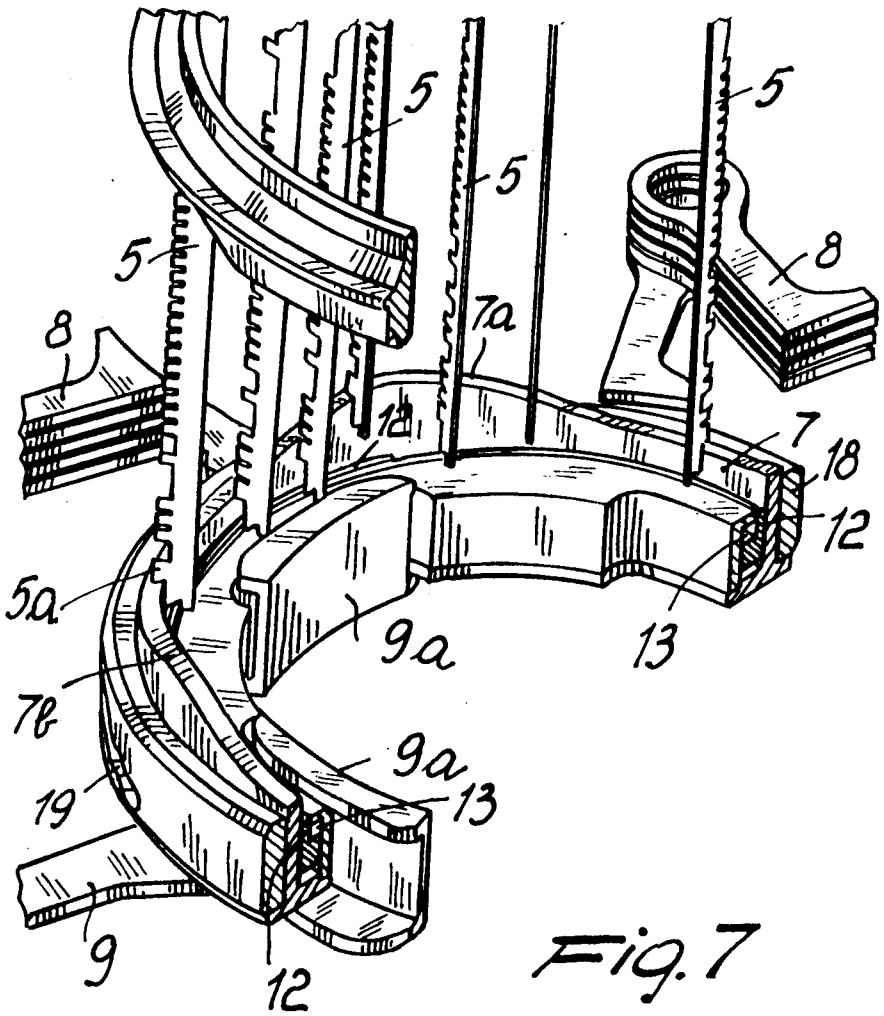
FIG. 7 is a perspective view of the machine, taken similarly to FIG. 6, with the memory element in an operative position.

With reference to the above-cited figures, the machine according to the invention, generally indicated by the reference numeral 1, comprises a needle cylinder 2 which can be actuated with a rotary motion about its axis 2*a* and in which a plurality of grooves 3 are defined along its lateral surface and extend parallel to the axis 2*a*. A needle 4, and a selector 5 below said needle, are accommodated inside each groove 3 and can slide in a direction which is parallel to the axis 2*a*. Each selector 5 has, proximate to its lower end, a main heel 5*a* which is directed toward the outside of the needle cylinder and, above said main heel, a plurality of secondary selection heels 5*b*. The selectors 5 can individually oscillate in a radial plane of the needle cylinder from a sunk position, in which the main heel 5*a* and the secondary selection heels 5*b* are contained in the radial dimensions of the needle cylinder, to an extraction position, in which the heel 5*a* and the secondary heels 5*b* protrude radially from the needle cylinder 2.

Actuation cams 6 are arranged around the needle cylinder 2 and define paths which can be engaged by the main heel 5*a* of the selectors in the extraction position.

In the illustrated embodiment, which relates to a circular machine with four feeds, the arrangement whereof is schematically indicated in FIG. 5 by the reference letters A, B, C and D, the actuation cams are constituted by an annular cam or ring 7 which extends around the needle cylinder proximate to the lower end of the selectors 5.

Said annular cam 7 has four raised portions 7*a*, 7*b*, 7*c*, 7*d* proximate to the machine thread feeds, i.e. four raised portions which are mutually angularly spaced with respect to the axis 2*a* of the needle cylinder.

Upstream of each feed, the selectors 5 which are in extraction position, by rising along the corresponding raised portion of the annular cam 7 with their main heel 5*a*, push the overlying needles along a direction which is parallel to the axis 2*a* to engage the thread at the feed being considered.

In order to determine which needles must engage the thread at a preset feed, selection means are provided upstream of said feed along the direction of rotation of the needle cylinder and comprise a plurality of selection levers 8 which are mutually stacked along a direction which is parallel to the axis 2*a* and are arranged with one of their ends 8*a* facing the needle cylinder.

The selection levers 8 are arranged at mutually different elevation levels corresponding to the various levels of the secondary heels 5*b* of the selectors. Each selection lever can be actuated in a known manner so as to interfere or not interfere with a secondary heel 5b of the selectors to move the related selector from the extraction position to the sunk position. The actuation of given selection levers, combined with the arrangement of the secondary selection heels 5b along the selectors, allows to keep in an extraction position only the selectors which are arranged below the needles which must knit at the feed being considered. The selectors which are in the extraction position after they have passed the selection levers 8 due to the rotation of the needle cylinder rise along the related raised portion *7a*, *7b*, *7c*, *7d* of the annular cam 7, pushing the related needle to engage the thread, whereas the selectors which are pushed by the selection levers 8 from the extraction position to the sunk position pass with their main heel 5a sunk in the related groove 3 inside the annular cam 7 and therefore do not act on the related needles, which are not moved to engage the thread at that feed.

An extraction element 9 is provided upstream of each set of selection levers and acts on the selectors in a sunk position to move them into extraction position so as to undergo selection on the part of the levers 8.

More particularly, the annular cam 7 has a lower edge 10 in the shape of a planar annulus which is concentric with respect to the needle cylinder and defines a resting plane which is substantially perpendicular to the axis *2a* for the lower end of the selectors 5. The extraction elements 9 are individually pivoted to said lower edge 10 about axes 11 which are parallel to the axis *2a* and have a profile *9a* which acts on the inner side of the lower end of the selectors 5 in sunk position to move them to the extraction position. By virtue of the oscillation of the extraction element 9 about the axis 11 it is possible to move the profile *9a* toward the inside of the needle cylinder, preventing, if required, its interference with the selectors in a sunk position.

According to the invention, there is a memory element 12 which is arranged proximate to the lower end of the selectors 5 and has at least one portion with a curvilinear extension which is concentric to the needle cylinder. The element 12 is arranged between two contiguous feeds of the machine and is controllably movable, parallel to the axis *2a*, from an inoperative position, in which it does not interfere with the oscillation of the selectors, to an operative position in which it defines differentiated paths for the lower end of the selectors so as to maintain the position of the selectors set previously by the selection means arranged upstream of the first feed.

The memory element 12 is constituted by an annular body which is arranged concentrically to the needle cylinder 2 and is accommodated in an annular seat defined above the lower edge 10 and adjacent to the annular cam 7 (see FIG. 6). The seat 13 is open upwardly to allow the passage of the upper edge of the annular body 12.

The upper edge of the annular body 12 has recesses 14 at the region affected by the extraction elements 9 and by the selection levers 8 upstream of the feeds at which a needle selection is to be performed in any case. Recesses 14 are provided, in the illustrated machine, immediately upstream of the first feed A and of the third feed C. The depth of said recesses 14 is such that when the annular body is in its operative position the base of the recess 14 is below or at the same level as the resting plane of the lower end of the selectors which is defined by the lower edge 10 of the annular cam 7.

Each selector conveniently has, on its lower side which is directed toward the resting plane defined by the edge 10, an indent 15 which can be engaged astride the upper edge of the annular body 12, except for the region affected by the recesses 14, when said annular body 12 is in an operative position and the selector is in an extraction position.

The annular body 12 has, in diametrical opposite positions, two pins 16 which are arranged radially on its outer surface. The pins 16 pass through a vertical slot 17 defined in the annular cam 7 and engage actuation means arranged externally to said cam 7.

Said actuation means comprise an actuation ring 18 which surrounds the annular cam 7 and has, at the pins 16, a shaped slot 19 with horizontal portions 20, 21 and 22 which are mutually connected by rising portions 23 and 24.

The actuation ring 18 is rotatable about the axis *2a*, for example by means of pneumatic actuators of a known type which cause its partial rotation so as to move the pins 16 to engage the portions 20, 21 or 22.

When the pins 16 are engaged with the portion 20, the annular body 12 is in inoperative position; when the pins 16 are engaged with the portion 21, the annular body 12 is in an operative position; when the pins 16 are engaged with the portion 22, the upper edge of the annular body 12 protrudes further from the resting plane defined by the edge 10. In this last position, the annular body 12 protrudes above the edge 10 by an extent which is greater than the depth of the recesses 14 so as to define a continuous circular barrier to the outside of the selectors which have been moved into sunk position beforehand. In this manner, for knittings in which a selection of the needles is not required since said needles are actuated autonomously by means of cams 25 which act directly on the heel 4a of the needles, it is possible to achieve high rotation rates of the needle cylinder about its axis *2a* with no risk that the selectors may pass, due to the centrifugal force, form the sunk position to the extraction position.

The operation of the machine according to the invention is as follows.

If the same needles which were selected at the preceding feed, i.e. at the first feed A and at the third feed C, are to be moved to knit at the second feed B or at the fourth feed D, the memory element 12 is moved into its operative position.

With the memory element 12 in this position it is possible to perform the required selection at the first feed A and at the third feed C, moving the selectors 5 into extraction position by means of the corresponding extraction element 9 so that they undergo the selection imposed by the levers 8. It should be noted that in this step the memory element 12 does not interfere with the selectors during the extraction operation performed by the elements 9, since said memory element 12 has the recesses 14 at the extraction element 9 and at the levers 8 which are arranged immediately upstream of the feeds A and C.

The selectors which are moved to the sunk position pass with their lower end inside the memory element 12 at the end of the recesses 14 as well, whereas the selectors which are in an extraction position after the performed selection rise along the raised portions *7a*, *7c* and move the related needles to knit. During the descent from the raised portions *7a*, *7c*, the selectors engage the indent 15 with the upper edge of the memory element 12 and are therefore kept in extraction position.

Due to this reason, the same selectors which had risen along the raised portions *7a* and *7c* remain engaged with the annular cam 7 and also rise along the subsequent raised portions *7b* and *7d*, moving the same needles which had knitted at the preceding feed A, C to knit at the subsequent feed B, D.

The selectors which have their lower end inside the memory element 12 are kept in sunk position by the presence of the memory element 12 even if the cylinder is actuated with a high rotation rate.

Therefore, between the feed A and the feed B, as well as between the feed C and the feed D, it is not necessary to perform the selection by means of the selection levers 8, and the related extraction element 9 is moved, by exploiting its ability to oscillate about the related axis 11, in a position of non-interference with the lower end of the selectors in a sunk position.

If a repetition of the selection of the needles performed upstream of the feeds A and B is not required, the memory element 12 is moved into inoperative position, and the extraction elements 9 related to the feeds B and D are actuated so as to move all the selectors into extraction position so as to undergo a new selection on the part of the levers 8 arranged upstream of the respective feeds. When no needle selection is required, with all the selectors in a sunk position, the memory element 12 is raised beyond the operative position so as to lock the selectors 5 in the sunk position, allowing to achieve high rotation rates of the needle cylinder without problems.

In practice it has been observed that the machine according to the invention fully achieves the intended aim, since it allows to maintain, at a subsequent feed, the same needle selection performed at a preceding feed without necessarily having to perform a new selection, reducing impacts and wear of the selectors even with high speeds of actuation of the needle cylinder with respect to conventional machines.

The machine thus conceived is susceptible to numerous modifications and variations, all of which are within the scope of the inventive concept; all the details may furthermore be replaced with other technically equivalent elements.

In practice, the materials employed, as well as the dimensions, may be any according to the requirements and the state of the art.

I claim:

1. Circular knitting machine with a device for repeating needle selection at least at one thread feed, comprising; a needle cylinder having a lateral surface, a plurality of grooves defined on said lateral surface, an axis defined by said needle cylinder, said grooves being substantially parallel to said axis of said needle cylinder, a needle and at least one selector being accommodated inside each of said grooves, said needle and said selector being slideable along a direction substantially parallel to said axis of said needle cylinder, said selector being arranged below said needle and having a lower end and a main heel, said selector being controllably oscillable, in a radial plane of said needle cylinder, from an extraction position, whereat said main heel protrudes radially from one of said grooves, to a sunk position, whereat said main heel is contained within said one of said grooves, actuation cams arranged laterally facing said needle cylinder and defining paths engageable by said main heel in said extraction position, said needle cylinder being rotatable relatively to said actuation cams and defining a direction of rotation, whereby rotation of said needle cylinder about said axis in said direction of rotation causes movement of said selector along said one of said grooves in a direction parallel to said axis, at least two feeds mutually angularly spaced with respect to said axis, selection means arranged upstream of at least one of said feeds according to said direction of rotation and controllably interacting with said selectors for causing oscillation movement of said selectors from said extraction position to said sunk position and vice versa, said machine further comprising a memory element, said memory element being arranged proximate to said lower end of said at least one selector and having an upper edge and at least one portion, said portion defining a curvilinear shape concentric to said needle cylinder, said memory element being arranged between said two feeds and controllably movable parallel to said axis from an inoperative position, whereat said memory element does not interfere with said oscillation movement of said selector, to an operative position, whereat said memory element defines differentiated paths for said lower end of said selector, whereby to maintain the position of said selector set previously by said selection means, wherein said memory element comprises an annular body, said annular body being arranged concentrically to said needle cylinder and accommodated in a seat, said seat being defined adjacent a ring, said lower end of said selector resting on said ring, said ring defining a resting plane for said lower end of said selector and having a region comprised between said two feeds, said seat being open upwardly whereby to permit movement of said memory element between said inoperative position, whereat said upper edge is arranged below said resting plane, to said operative position, whereat said upper edge protrudes upwardly from said resting plane in said region of said ring comprised between said two feeds, and wherein said annular body has a recess, said recess being defined on said upper edge opposite said selection means, said recess defining a depth and a bottom, said depth of said recess being such that when said memory element is in said operative position, said bottom of said recess is arranged below or on a level with said resting plane.

2. Circular knitting machine according to claim 1, wherein said selector has, on their lower side arranged facing said resting ring, an indent which can be engaged astride the upper edge of said memory element, in said memory position, with said selectors in extraction position.

3. Circular knitting machine with a device for repeating needle selection at least at one thread feed, comprising;

a needle cylinder having a lateral surface and defining an axis;

a plurality of grooves defined on said lateral surface, substantially parallel to said axis;

a needle accommodated inside each of said grooves;

at least one selector accommodated inside each of said grooves below said needle, said needle and said selector being slideable along a direction substantially parallel to said axis, said selector having a lower end and a main heel, said selector being controllably oscillable, in a radial plane of said needle cylinder, from an extraction position, whereat said main heel protrudes radially from one of said grooves, to a sunk position, whereat said main heel is contained within said one of said grooves;

actuation cams arranged laterally facing said needle cylinder and defining paths engageable by said main heel in said extraction position, said needle cylinder being rotatable relatively to said actuation cams and defining a direction of rotation, whereby rotation of said needle cylinder about said axis in said direction of rotation causes movement of said selector along said one of said grooves in a direction parallel to said axis;

at least two feeds mutually angularly spaced with respect to said axis, selection means arranged upstream of at least one of said feeds according to said direction of rotation and controllably interacting with said selectors for causing oscillation movement of said selectors from said extraction position to said sunk position and vice versa, a memory element arranged proximate to said lower end of said selector and having an upper edge and at least one portion, said portion defining a curvilinear shape concentric to said needle cylinder, said memory element being arranged between said two feeds and controllably movable parallel to said axis from an inoperative position, whereat said memory element does not interfere with said oscillation movement of said selector, to an operative position, whereat said memory element defines differentiated paths for said lower end of said selector, whereby to maintain the position of said selector set previously by said selection means.

4. Circular knitting machine according to claim 3, wherein said memory element comprises an annular body, said annular body being arranged concentrically to said needle cylinder and accommodated in a seat, said seat being defined adjacent a ring, said ring defining a resting plane for said lower end of said selector and having a region comprised between said two feeds, said lower end of said selector resting on said ring, said seat being open upwardly whereby to permit movement of said memory element between said inoperative position, whereat said upper edge is arranged below said resting plane, to said operative position, whereat said upper edge protrudes upwardly from said resting plane in said region of said ring comprised between said two feeds.

5. Circular knitting machine according to claim 3, wherein said annular body has a recess, said recess being defined on said upper edge opposite said selection means, said recess defining a bottom, said bottom of said recess being arranged below or on a level with said resting plane when said memory element is in said operative position.

6. Circular knitting machine according to claim 3, further comprising a ring arranged coaxially with said needle cylinder and defining a resting plane, wherein said lower end of said selector rests on said resting plane when said memory element is in said inoperative position, and wherein said lower end of said selector is engaged by said memory element and moved upwardly from said resting plane when said memory element is in said opeative position.

7. Circular knitting machine according to claim 6, wherein said memory element has an upper edge, and wherein said lower edge of said selector has formed therein at least one indent, said indent being engaged by said upper edge of said memory element when said memory element is in said operative position.

8. Circular knitting machine according to claim 6, wherein said memory element has an upper edge, and wherein said lower edge of said selector has formed therein at least one indent, said indent being engaged by said upper edge of said memory element when said memory element is in said operative position, and wherein said indent engages astride said upper edge of said memory element.

9. Circular knitting machine with a device for repeating needle selection at least at one thread feed, comprising;

a needle cylinder having a lateral surface and defining an axis;

a plurality of grooves defined on said lateral surface, substantially parallel to said axis;

a needle accommodated inside each of said grooves;

at least one selector accommodated inside each of said grooves below said needle, said needle and said selector being slideable along a direction substantially parallel to said axis, said selector having a lower end and a main heel, said selector being controllably oscillable, in a radial plane of said needle cylinder, from an extraction position, whereat said main heel protrudes radially from one of said grooves, to a sunk position, whereat said main heel is contained within said one of said grooves;

actuation cams arranged laterally facing said needle cylinder and defining paths engageable by said main heel in said extraction position, said needle cylinder being rotatable relatively to said actuation cams and defining a direction of rotation, whereby rotation of said needle cylinder about said axis in said direction of rotation causes movement of said selector along said one of said grooves in a direction parallel to said axis;

at least two feeds mutually angularly spaced with respect to said axis, selection means arranged upstream of at least one of said feeds according to said direction of rotation and controllably interacting with said selectors for causing oscillation movement of said selectors from said extraction position to said sunk position and vice versa, a memory element arranged proximate to said lower end of said selector and having an upper edge and at least one portion, said portion defining a curvilinear shape concentric to said needle cylinder, said memory element being arranged between said two feeds and controllably movable parallel to said axis from an inoperative position, whereat said memory element does not interfere with said oscillation movement of said selector, to an operative position, whereat said memory element defines differentiated paths for said lower end of said selector, whereby to maintain the position of said selector set previously by said selection means;

a ring arranged coaxially with said needle cylinder and defining a resting plane;

wherein said lower end of said selector rests on said resting plane when said memory element is in said inoperative position, and wherein said lower end of said selector is engaged by said memory element and moved upwardly from said resting plane when said memory element is in said operative position.

10. Circular knitting machine according to claim 9, wherein said memory element has an upper edge, and wherein said lower edge of said selector has formed therein at least one indent, said indent being engaged by said upper edge of said memory element when said memory element is in said operative position.

11. Circular knitting machine according to claim 10, wherein said indent of said lower edge of said selector engages astride said upper edge of said memory element.

* * * * *